US010820699B2

(12) United States Patent
Gonzalez

(10) Patent No.: US 10,820,699 B2
(45) Date of Patent: Nov. 3, 2020

(54) PROFILE FOR ARTICLE OF FURNITURE, SYSTEM OF PROFILES FOR ARTICLE OF FURNITURE AND METHOD FOR ASSEMBLING AN ARTICLE OF FURNITURE

(71) Applicant: Archi Comercio de Puxadores Ltda., Sao Paulo (BR)

(72) Inventor: Jose Luis Gonzalez, Sao Paulo (BR)

(73) Assignee: ARCHI COMERCIO DE PUXADORES LTDA.

( * ) Notice: Subject to any disclaimer, the term of this patent is extended or adjusted under 35 U.S.C. 154(b) by 0 days.

(21) Appl. No.: 16/328,110

(22) PCT Filed: May 16, 2017

(86) PCT No.: PCT/BR2017/050116
§ 371 (c)(1),
(2) Date: Feb. 25, 2019

(87) PCT Pub. No.: WO2018/035590
PCT Pub. Date: Mar. 1, 2018

(65) Prior Publication Data

US 2019/0183245 A1 Jun. 20, 2019

(30) Foreign Application Priority Data

Aug. 25, 2016 (BR) ..... 102016019700

(51) Int. Cl.
*A47B 95/04* (2006.01)
*A47B 96/20* (2006.01)

(52) U.S. Cl.
CPC ..... *A47B 95/043* (2013.01); *A47B 96/20* (2013.01); *A47B 2230/0077* (2013.01)

(58) Field of Classification Search
CPC ..... A47B 95/043; A47B 96/20; A47B 2230/0077; A47B 2230/00
USPC ..... 108/27, 180, 153.1, 154
See application file for complete search history.

(56) References Cited

U.S. PATENT DOCUMENTS 1,690,286 A * 11/1928 Fitch ..... A47B 13/083 108/153.1
2,509,037 A * 5/1950 Flicker ..... A47B 13/083 108/27
2,697,019 A * 12/1954 Edwin ..... A47J 47/20 108/27
2,853,750 A * 9/1958 Davies ..... A47B 13/083 52/718.02

(Continued)

FOREIGN PATENT DOCUMENTS

DE 1 554 341 11/1969
GB 2 226 952 A 7/1990

OTHER PUBLICATIONS

International Search Report dated Aug. 16, 2017 for International Application No. PCT/BR2017/050116.

(Continued)

*Primary Examiner* — Jose V Chen
(74) *Attorney, Agent, or Firm* — Fay Sharpe LLP

(57) ABSTRACT

A profile (10,20) for article of furniture is structurally configured to establish a first association position (30) and a second association position (31) in relation to the article of furniture, thus enabling flexibility in producing and assembling the profile and its corresponding system, and providing the user with an array of easy-to-apply finish options.

17 Claims, 5 Drawing Sheets

(56) References Cited

Figure 1:
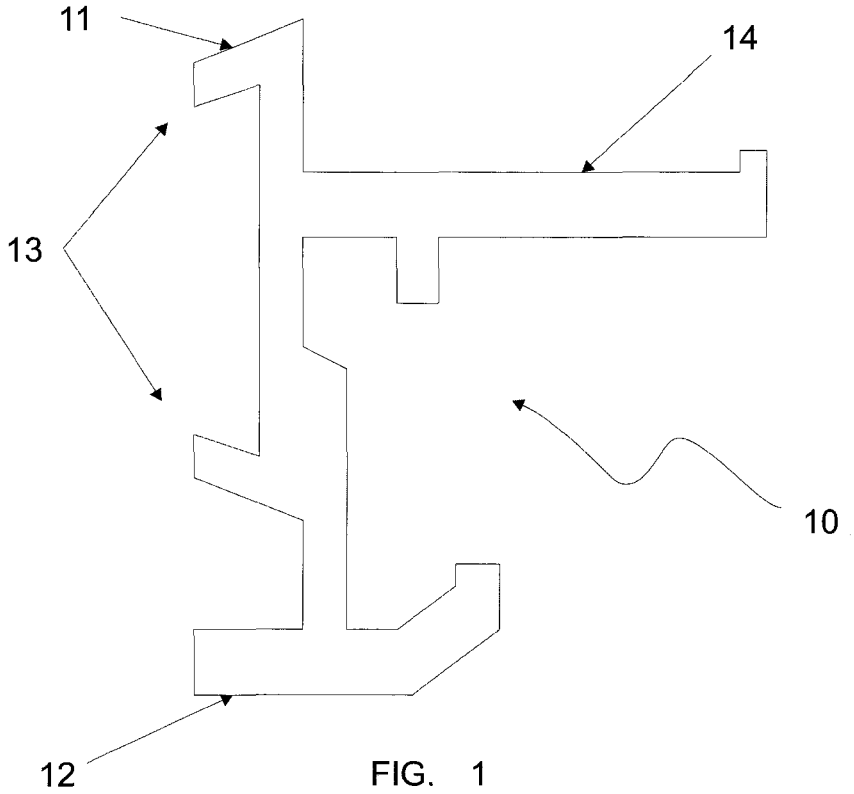

U.S. PATENT DOCUMENTS 2,940,805 A * 6/1960 Nordmark ..... A47B 13/083 108/27
3,294,353 A * 12/1966 Rowe ..... E04C 2/384 248/346.01
3,669,033 A * 6/1972 Murcia ..... A47B 47/021 108/180
4,015,545 A * 4/1977 Kurokawa ..... A47F 3/001 108/107
4,606,170 A * 8/1986 Mendenhall ..... A47B 95/043 108/27
4,934,541 A * 6/1990 Bussan ..... F25D 25/02 108/27
5,026,588 A * 6/1991 Diekmann ..... A47B 95/043 248/345.1
5,039,177 A 8/1991 Newell et al.
5,173,348 A * 12/1992 Gevaert ..... A47B 13/083 312/137
5,436,048 A * 7/1995 Meier ..... A47B 13/083 108/27
5,497,597 A * 3/1996 Elzenbeck ..... A47B 13/083 52/782.24
6,135,581 A * 10/2000 Kopp ..... A47B 77/022 108/27
6,183,585 B1 * 2/2001 Kelley ..... A47B 95/043 144/347
6,571,498 B1 * 6/2003 Cyrluk ..... G09F 3/204 108/27
9,540,800 B2 * 1/2017 Laurindo ..... E04B 1/12
2002/0178684 A1 * 12/2002 Barnett ..... A47B 95/043 52/716.1
2008/0093526 A1 * 4/2008 Fife ..... A47B 95/043 248/687
2012/0321378 A1 * 12/2012 Velez, Jr. ..... F16B 12/20 403/300
2013/0097811 A1 * 4/2013 Wilbs ..... E05D 15/0691 16/96 R
2018/0128035 A1 * 5/2018 Kim ..... A47G 1/06
2019/0350108 A1 * 11/2019 Davis ..... H05K 7/20836

OTHER PUBLICATIONS

Written Opinion of the International Searching Authority dated Aug. 16, 2017 for International Application No. PCT/BR2017/050116.
Written Opinion of the International Preliminary Examining Authority dated Sep. 4, 2018 for International Application No. PCT/BR2017/050116.
International Preliminary Report on Patentability completed Nov. 16, 2018 for International Application No. PCT/BR2017/050116.

* cited by examiner

PROFILE FOR ARTICLE OF FURNITURE, SYSTEM OF PROFILES FOR ARTICLE OF FURNITURE AND METHOD FOR ASSEMBLING AN ARTICLE OF FURNITURE

The present invention relates to a system of profiles applicable to articles of furniture. More specifically, it relates to a system that allows one to choose between two association positions in a fast and simple way, thus resulting in two kinds of outer finishes. The invention also relates to a profile for article of furniture and a method for assembling it.

DESCRIPTION OF THE PRIOR ART

When it comes to articles of furniture, the outer finish plays an important role in their commercial value and appeal. More specially, the outer finish of a structural component of the article of furniture (a door, cover, glass or any other component) must hold a special visual appeal that captures the consumer's attention and pleases him. Thus, it is important and recommended that such outer finish should be easy to assemble and flexible to apply.

Currently, finishes of articles of furniture are the single profile type. Such profile forms the frame that receives and sustains the structural component of the article of furniture, acting both as a structural profile and a finish profile.

The finish provided to the article of furniture by such kind of profile is extremely limited in many ways. First of all, the profile known in the art does not allow for a wide diversity of finish types. Since it is a single profile that encompasses structure and finish, it is not possible to substantially alter the making thereof in a way that results in an innovative finish, for it might compromise the structure of the profile or hamper the assembly thereof.

Thus, the only possible finish options for the profile known in the art depend upon the positioning of the structural component of the article of furniture itself: its position or association means can be changed in relation to the frame in order to enable the user to visualize a bigger or smaller portion of the profile. In a nutshell, such alteration does not result in substantial changes in the appearance of the article of furniture; therefore, the finish options utilizing such profile are limited.

Moreover, utilizing the profile known in the art brings down on both the consumer and the manufacturer several economic problems. Thus, the profile manufacturer finds himself obligated to produce and store profiles of different finish types, since a prior-art profile will provide only one finish type for the article of furniture. That results in bigger storage and logistic expenses to both the manufacturer and the retailer.

Furthermore, the use of a single profile containing structure and finish implies that, in the event one wishes a different finish for an article of furniture already assembled, all the structure of the frame of the article needs to be changed, including all the profiles, which results in bigger expenses and inconvenience to the end consumer.

Thus, the profiles known in the art for application in articles of furniture do not have diversity of options in terms of visual finish, and bring on economic difficulties arising from its lack of adaptability.

Hence, a system of profiles for application in an article of furniture that promotes flexibility in the application of the finish type and is economical and practical to both the manufacturer and the user of the profile was not found in the prior art.

The present invention aims at solving the abovementioned problems by means of a profile and a system of profiles applicable to articles of furniture, which enables not only a wider diversity of finish types for articles of furniture but also allows for the choice between two distinct finish types in a fast and practical way by merely rotating the profile transverse-wise.

OBJECTIVES OF THE INVENTION

A first objective of the present invention is to provide a profile applicable to a system of profiles of articles of furniture that enables one to choose at least two finish types from its structural configuration.

Another objective of the present invention is to provide a system of profiles for articles of furniture that enables one to choose the outer finish type for the article of furniture from the structural configuration of the profiles which form the system.

A further objective of the present invention is a system of profiles for articles of furniture that can provide the furniture with at least two finish types.

Another objective of the present invention is to provide a system of profiles for articles of furniture that promotes logistic and storage economy to the manufacturer of the profile.

A further objective of the present invention is a system of profiles for articles of furniture convenient and practical to the manufacturer and user when it comes to changing the desired finish type.

Last, the present invention aims to provide a method for assembling an article of furniture.

BRIEF DESCRIPTION OF THE INVENTION

The present invention relates to a profile for article of furniture structurally configured to establish a first association position and a second association position in relation to the article of furniture.

The first and second association positions are, preferably, configured by means of relative transverse rotation of the profile. The profile is, preferably, provided with at least one assembly protrusion configured to couple with at least one assembly protrusion of a second profile.

In addition, the profile comprises a first end and a second end defined along opposite sides of its length, the first end being directly associated with a structural component of the article of furniture and, alternatively, the second end defining a gap between a structural component of the article of furniture and the profile.

The present invention also relates to a system of profiles for article of furniture comprising at least a first profile that can be associated with a second profile, said second profile being structurally configured to establish a first association position and a second association position with the first profile.

Thus, the first and second association positions are configured by means of relative transverse rotation of any of the profiles. The first profile is also provided with at least one assembly protrusion configured to couple with at least one assembly protrusion of the second profile.

In addition, the second profile comprises a first end and a second end defined along opposite sides of its length, the first profile comprising an end that can receive a structural component of the article of furniture and wherein in the first association position the first end of the second profile is directly associated with the structural component.

Conversely, in the second association position the second end of the second profile defines a gap between the structural component and the second profile. Additionally, the first end of the second profile has a hook-like shape, which covers the first end of the first profile when the first and second profiles are associated, the first end of the second profile being directly associated with the structural component.

Furthermore, the present invention relates to a method for assembling an article of furniture by means of at least a first profile and at least a second profile, said method comprising the steps of:

associating the first profile with a fixed structure of the article of furniture;

associating the second profile with the first profile, wherein said association defines a first association position and a second association position between the profiles.

The method can also, preferably, comprise the step of:

transversely rotating either the first or the second profile in relation to the other, thereby altering the first or second association position.

Still concerning the method, the second profile comprises a first end and a second end defined along opposite sides of its length, the first profile comprising an extension that can receive a structural component of the article of furniture, in such a way that said method comprises the step of:

directly associating the first end of the second profile 20 with the structural component of the article of furniture, thus defining the first association position or defining a gap between the structural component and the second profile, said gap being defined by means of the second end of the second profile, thus resulting in the second association position.

Moreover, the first and second profiles are each provided with at least one assembly protrusion, said method comprising the step of:

coupling the assembly protrusion of the first profile with the assembly protrusion of the second profile when the first profile is associated with the second profile.

SUMMARIZED DESCRIPTION OF THE FIGURES

Figure 2:
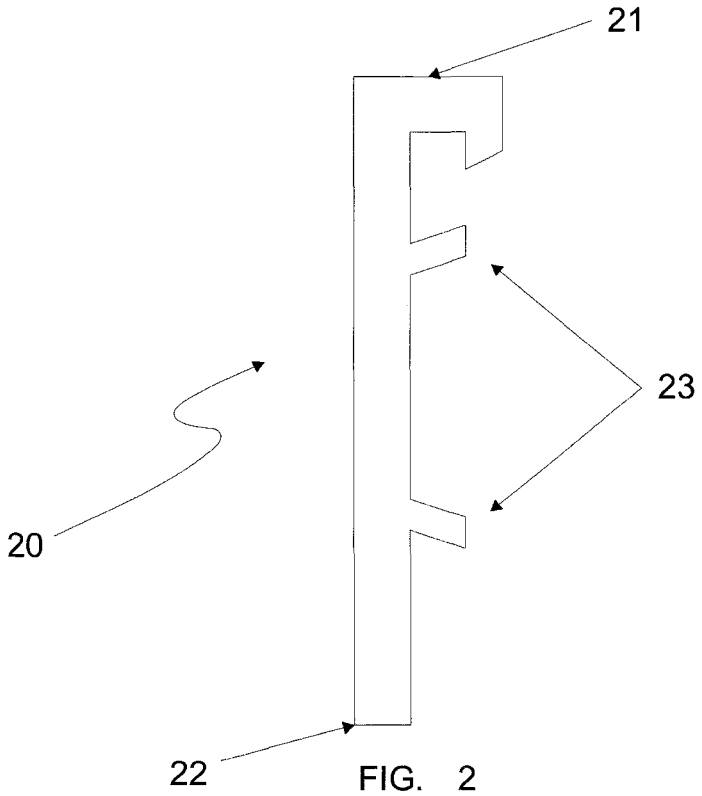
Figure 3:
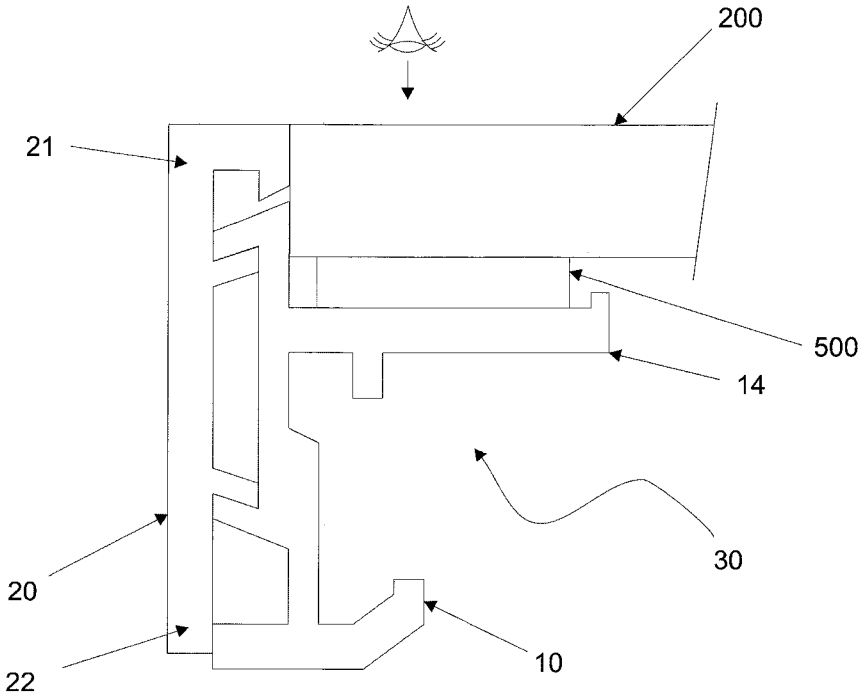
Figure 4:
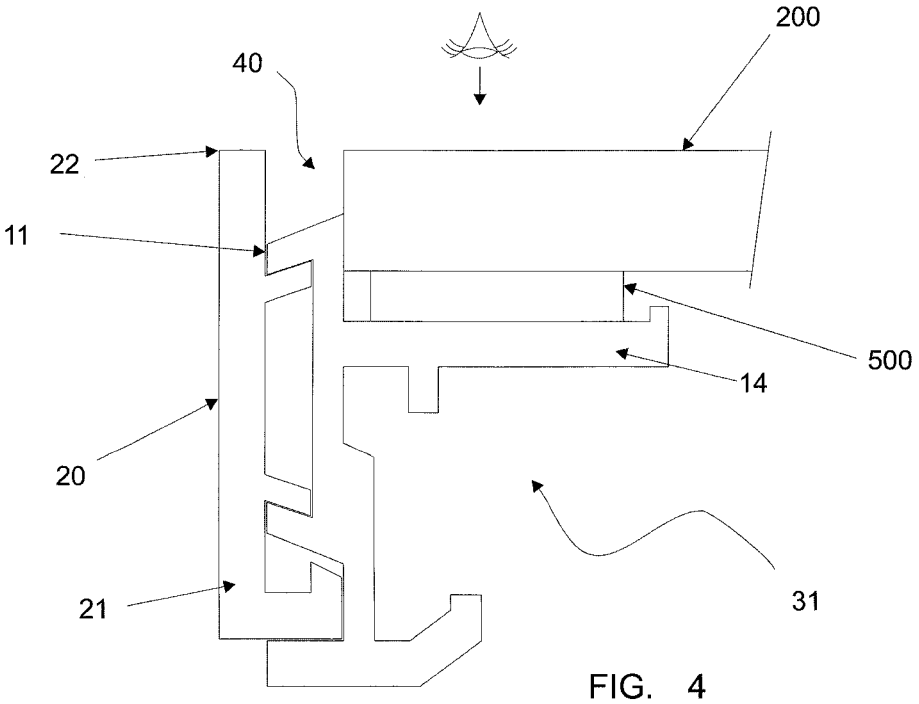
Figure 5:
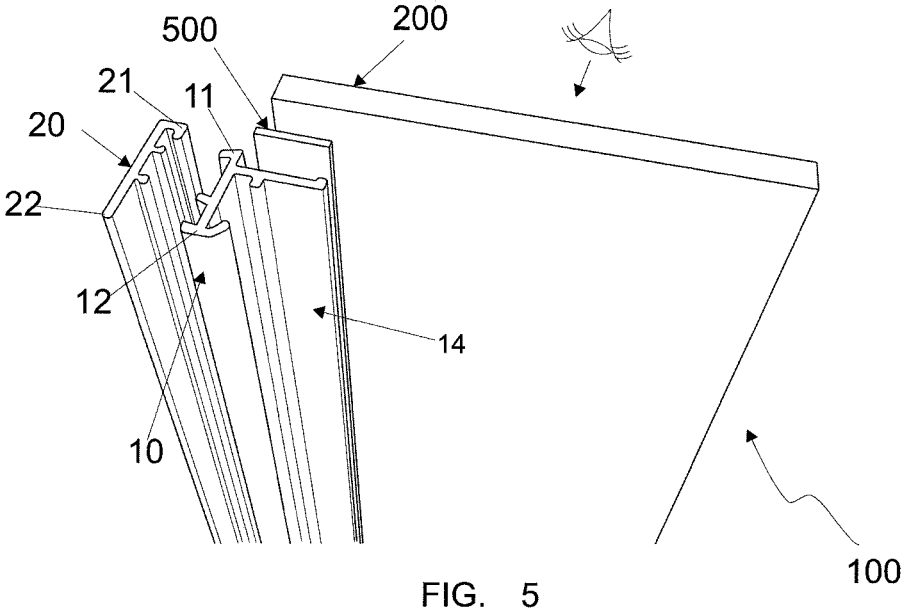
Figure 6:
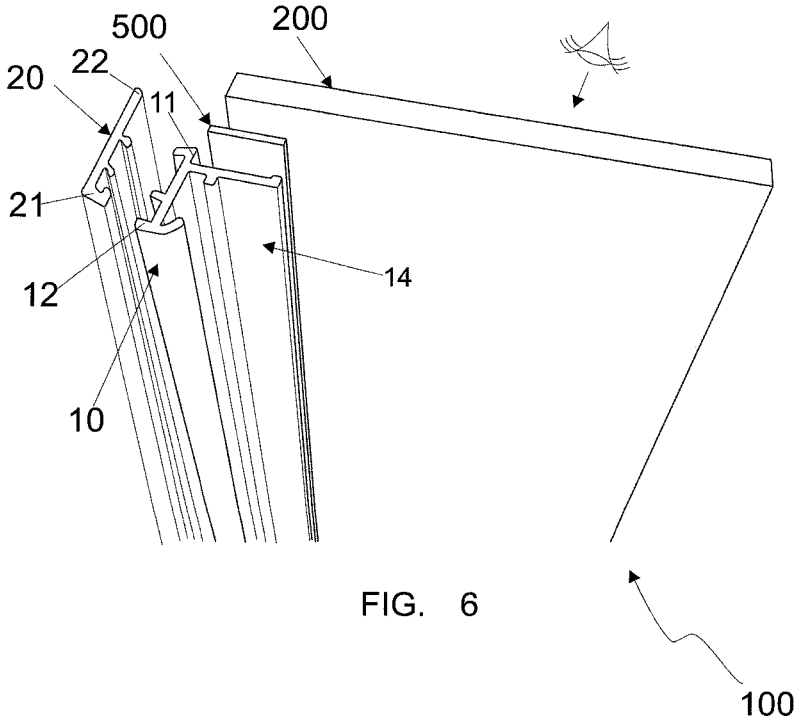
Figure 7:
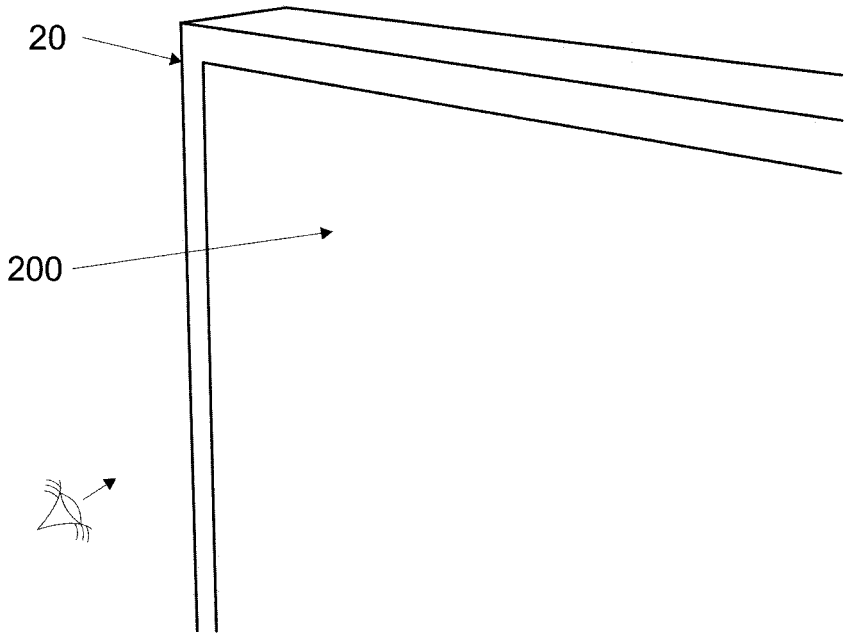
Figure 8:
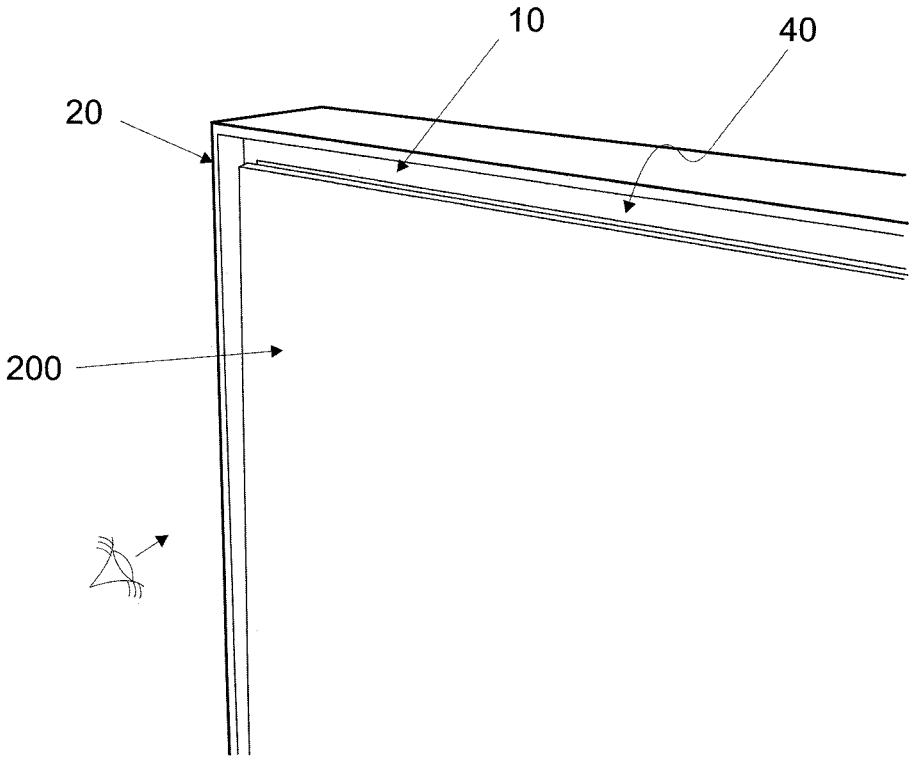
Figure 9:
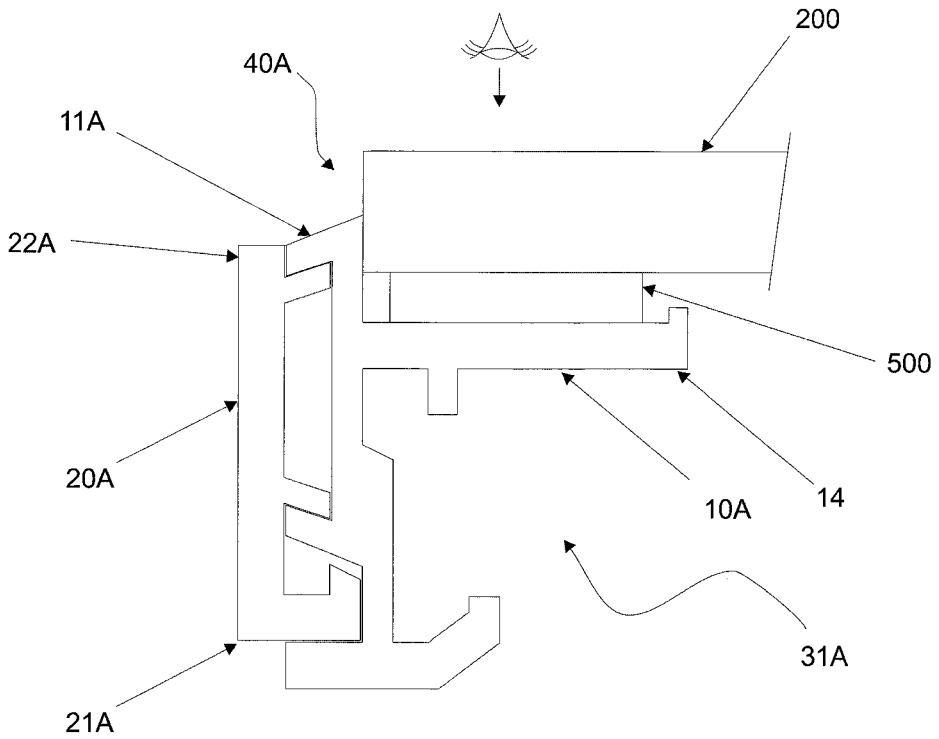
Figure 10:
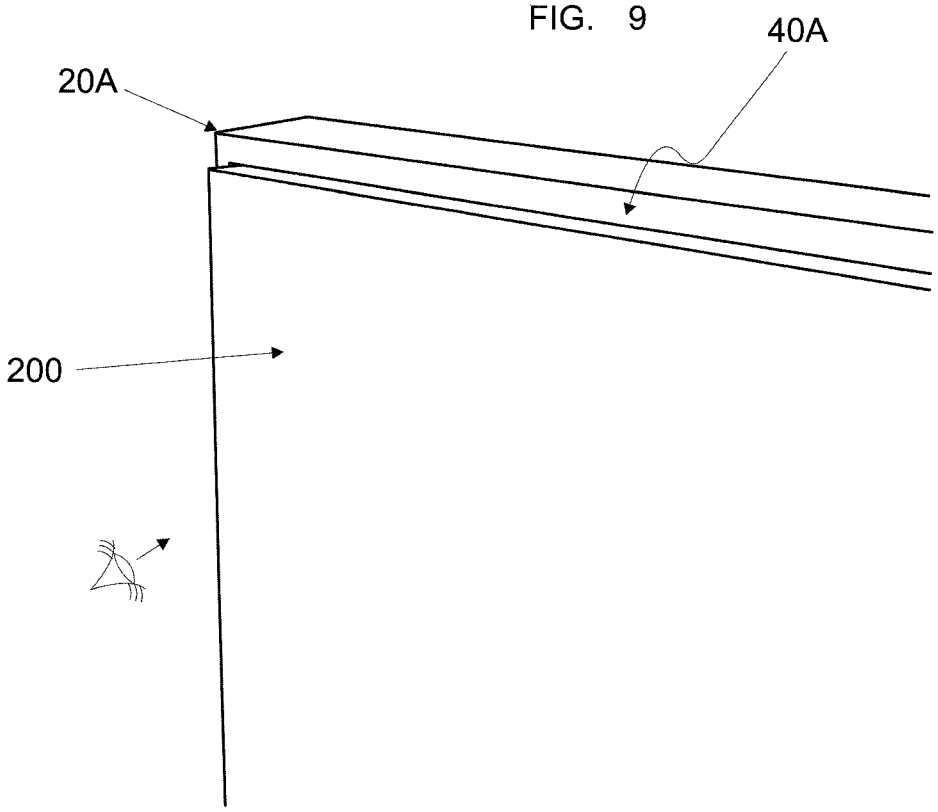

Below, the present invention will be thoroughly described based on an embodiment example displayed in the figures. The figures show:

FIG. 1—is a cross-sectional view of the base profile of the system of the present invention;

FIG. 2—is a cross-sectional view of the outer finish profile of the system of the present invention;

FIG. 3—is a cross-sectional view of the first association position of the profiles of the system of the present invention;

FIG. 4—is a cross-sectional view of the second association position of the profiles of the system of the present invention;

FIG. 5—is an exploded view of the system of the present invention applied to furniture in the first association position;

FIG. 6—is an exploded view of the system of the present invention applied to furniture in the second association position;

FIG. 7—is a perspective view of the system of the present invention applied to furniture in the first association position, showing in details a region that is visible to the article user;

FIG. 8—is a perspective view of the system of the present invention applied to furniture in the second association position, showing in details a region that is visible to the article user;

FIG. 9—is a cross-sectional view of an alternative configuration of the present invention; and FIG. 10—is a perspective view of the alternative configuration of the present invention applied to furniture.

DETAILED DESCRIPTION OF THE FIGURES

The present invention relates to a profile 10, 20, a system 100 of profiles and a method for assembling articles of furniture which utilizes the profile 10, 20 and the system 100. FIGS. 1 and 2 display preferred configurations for the profile 10, 20. FIGS. 3 and 4 display two possible association positions of the system 100 of the present invention utilizing the profiles 10, 20 according to the configurations shown in FIGS. 1 and 2.

FIGS. 5 and 6 show exploded views of the system 100 applied to an article of furniture from the two association positions displayed in FIGS. 3 and 4, respectively. FIGS. 7 and 8, in turn, show views of the article of furniture with the system 100 applied to it, in accordance with the application of the system 100 as shown by FIGS. 5 and 6, respectively, specifically detailing a region of the article of manufacture which is visible to the user.

For the purpose of clarity, article of furniture is any component comprising a fixed structure, such as a frame or a wall, with which the system 100 is associated.

Moreover, the article of furniture comprises a structural component 200, whether mobile or not, such as a door cover or an ornamental glass. In general terms, one should bear in mind that the system 100 of the present invention is employed in the assembly of doors and drawers for furniture.

The present invention relates, at first, to a profile 10, 20 provided with a structural configuration that enables one to establish two different association positions 30, 31 in relation to the article of furniture. More specifically, the profile 13, 20 establishes a first association position 30 to provide the article of furniture with a first finish type, and can also establish a second association position 31 to provide the article of furniture with a second finish type.

The profile 10, 20 in question can have various structural configurations, in such a way that it can be employed as a base profile, or a finish profile, for example. FIG. 1 shows a preferred configuration of the profile in question, comprising a base profile 10 structure. FIG. 2, in turn, shows a second preferred configuration of the profile in question, comprising a finish profile 20 structure. Both configurations displayed by FIGS. 1 and 2 enable the profile to establish two different association positions 30, 31 in relation to the article of furniture.

More specifically, the profile 10, 20 is provided with a first end 11, 21 and a second end 12, 22 along opposite sides of the length of the profile, as shown by FIGS. 1 and 2. Both ends have different structural configurations which, upon assembly of the system of profiles 100, produce different types of finish depending on the association position 30, 31 of the profile 10, 20 in relation to the article of furniture, as it will be shown below.

According to FIGS. 3 and 4, a first profile 10 and a second profile 20 can be used for enabling the assembly of the system 100 in two distinct association positions 30, 31. Preferably, the first profile 10 is a base profile, and the second profile 20 is a finish profile.

Still according to FIGS. 1 to 4, both the base profile 10 and the finish profile 20 have assembly protrusions 13, 23 that can couple with each other, said protrusions being preferably in the form of rails 13, 23, the association being performed by coupling said rails 13, 23.

Moreover, the base profile 10 is associated with the structural component 200 of the article of furniture by means of an extension. Such extension 14 must be understood as a preferably flat projection of the base profile 10 extending along its length, that can receive a structural component 200 such as glass, a wooden board or any other structural component in compliance with the article of furniture utilized.

It should be noted that the user of the article of furniture will visualize said article completely assembled from the structural component 200 side. For a better comprehension, said region visible to the user is indicated in FIGS. 3 to 7 by an eye accompanied by an arrow which indicates how the user sees it. Hence, the visual appeal of the article of furniture is concentrated on this region visible to the user.

FIG. 3 shows the first association position 30, in which the base profile 10 and the finish profile 20 are associated so that the first end 21 of the finish profile 20 is directly associated with the structural component 200 of the article of furniture. For clarity purposes, it is worth saying that "directly associated" must be understood as adjacently arranged and significantly close, without defining any visibly perceptible space between the first end 21 of the finish profile 20 and the structural component 200, as displayed by FIG. 3.

Therefore, considering the region visible to the user, it is clear that, in said first association position 30, the user sees the first end 21 of the finish profile 20 and the structural component 200. Subsequently, the construction and ornamental configurations of the first end 21 of the finish profile 20 define, together with the structural component 200, a first type of finish for the article of furniture from the first association position 30.

Thus, the second association position 31 is obtained by transversely rotating one of the profiles 10, 20 in relation to the other. Preferably, according to the configuration shown by FIGS. 3 and 4, the finish profile 20 is transversely rotated (or, in other words, rotated around its transverse axis) in relation to the base profile 10 from the first association position 30 (displayed in FIG. 3), at an angle of 180°, leading to the second association position 31 (displayed in FIG. 4).

Once again, considering the region visible to the user, in said second association position 31 the user sees the second end 22 of the finish profile 20, the first end 11 of the base profile 10 and the structural component 200. Subsequently, the construction and ornamental configurations of the second end 22 of the finish profile 20 and the first end 11 of the base profile 10 define, together with the structural component 200, a second type of finish for the article of furniture from the second association position 31.

In respect of that, it is worth saying that in such preferred configuration the profile rotated to establish the different association positions 30, 31 is the finish profile 20, but that the base profile 10 could also establish such positions 30, 31 through rotation.

Hence, it is clear that the profile 10, 20 of the present invention, when applied to the system 100 also herein proposed, enables one to obtain a first and a second distinct finish types for the article of furniture, the first one as a result of the first association position 30, enabling the user to directly visualize the first end 21 of the finish profile 20 together with the structural component 200 (as per FIGS. 3 and 5), and the second one as a result of the second association position 31, enabling the user to directly visualize the second end 22 of the finish profile 20 and the first end 11 of the base profile 10 together with the structural component 200 (as per FIGS. 4 and 6).

Thus—and according to the present invention —, from a first profile 10 and a second profile 20 (preferably base and finish profiles 10, 20) two different finish types can be obtained for the article of manufacture by merely rotating one of the profiles 10, 20 transverse-wise.

It results in more economy in the production of the system of profiles 100—for storage becomes more economical —, since only one finish profile needs to be stored for each two finish types desired (i.e., a profile that enables one to obtain two distinct finishes), instead of one profile for each finish type.

In addition, the present invention also provides the end user with the choice of the finish type, wherein said end user does not have to tie with its initial design choose.

Furthermore, the present invention is flexible as to the appearance of the article of furniture, since it is possible, for example, to utilize profiles of different colors depending on their length and width for assembling changeable and mosaic-like finishes.

It should also be noted that the finish type obtained with the first or second association positions 30, 31 depends upon the design of the ends 11, 21, 12, 22 of the profiles 10, 20, and the way they are arranged in relation to the structural component 200 of the article of furniture.

According to the configuration shown in FIGS. 3 and 5, i.e., according to the first association position 30, the first end 21 of the finish profile 20 has a hook-like shape, which covers the first end 11 of the base profile 10 and is directly associated with the structural component 200—one should bear in mind that "directly associated" must be understood as adjacently arranged and significantly close, without defining any visibly perceptible space between the first end 21 of the finish profile 20 and the structural component 200, as we explained before.

From the first association position 30, the first end 21 of the finish profile 20 and the way it is arranged in relation to the structural component 200 result in a significantly flat, smooth and gapless finish, as displayed in FIG. 7. In order to facilitate prospective references to such flat and gapless finish, it will be hereinafter referred to as "FLAT" finish.

In contrast, from the configuration displayed by FIGS. 4 and 6, i.e., from the second association position 31, a second end 22 of the finish profile 20 is in the form of a straight line, which does not cover the first end 11 of the base profile 10 and forms a gap 40 between it and the structural component 200.

Thus, from the second association position 31, the second end 22 of the finish profile 20 and the first end 11 of the base profile 10, and the way they are arranged in relation to the structural component 200, provide a finish that has a visibly perceptible gap between the structural component 200 and the finish profile 20, as displayed in FIG. 8. In order to facilitate prospective references to such finish provided with a gap, it will be hereinafter referred to as "GAP" finish.

It should be noted that such "GAP" finish cannot be obtained by utilizing profiles known in the art, for the occurrence of a gap from a single profile would weaken the structure of the article of furniture and render it difficult to assemble. The present invention overcomes such issue by dividing the structural component and the finish component of the system into base profiles 10 and finish profiles 20, respectively, thereby allowing a plurality of finishes to be applied to the article of furniture without one worrying about compromising the structural part of the system. In order to facilitate prospective references to such finish provided with a gap, it will be hereinafter referred to as "GAP" finish.

Thus, it is worth explaining that the present invention allows the article of furniture to have a wide diversity of finish types, without being restricted to the structural aspects of only one profile.

Furthermore, according to the present invention and its preferred configurations, a user would be able to choose between a "FLAT" finish and a "GAP" finish, and also alternate them by merely rotating a profile 10, 20 in relation to the other. Plus, a manufacturer of profiles for articles of furniture that makes use of the present invention will save on storage and logistics, for storing one type of profile for each finish type would no longer be necessary, but rather a base profile that suits all finish types, and a finish profile for every two finish types desired.

It is worth noticing that the system 100 of the present invention is not restricted to providing "FLAT" and "GAP" finishes, and that it is possible to obtain different final types of finish by altering the construction and ornamental configurations of the ends 11, 21, 12, 22 of the profiles 10, 20 and the arrangement thereof in relation to the structural component 200 of the article of furniture.

Aiming at clarifying the diversity of finishes that can be obtained by utilizing the present invention, we refer to FIGS. 9 and 10 which display an alternate configuration of the system of profiles in question. In this alternate configuration, the base profile 10A is identical to the base profile 10 utilized in the configuration displayed by FIGS. 1 to 8. The finish profile 20A, in turn, has a second end 22A which length is significantly smaller than the second end 22 of the finish profile 20 utilized in the configuration of FIGS. 1 to 8, while the rest of its construction remains identical.

From such alternate configuration, a first association position where the first end 21A of the finish profile 20A is adjacent to the structural component 200 would produce a finish similar to the one shown by FIG. 3.

With respect to that, in a second association position 31A displayed by FIG. 9 the second end 22A of the finish profile 20A ends substantially at the same level as that of the first end 11A of the base profile 10A.

Thus, the visual effect of the finish caused by such alternate configuration is such as that of a step formed by the high relief of the structural component 200 in contrast with the low relief formed by the base profile 10A and finish profile 20A, as shown in FIG. 10 (it is then understood that the structural component 200 is disposed in a different plane when compared to the profiles 10A and 20A). Hence, it is clear that the present invention enables one to obtain various finish types by modifying the structure of the base and finish profiles.

Moreover—and in compliance with the system 100 of profiles for articles of furniture disclosed —, the present invention also involves a method for assembling an article of furniture utilizing the system 100 of the present invention.

Such method of the system 100 of the present invention consists, at first, of the step of associating at least a first profile 10, 20 with a fixed structure of the article of furniture.

In that step, at least one profile 10, 20 is associated with the article of furniture by means of a fixed structure of the latter. As already explained, such fixed structure may be a wall or a frame of the article etc. The profile to be associated is, preferably, a base profile 10. The first base profile 10 can be associated with the fixed structure by means of any fixing element suitable for that, like a hinge. Additionally, the association of the base profile 10 with the fixed structure may or may not allow for any relative movement between them, like tilting fixing or fixing by sliding tracks.

Plus, it is possible to associate more than one base profile 10 with the fixed structure by forming a frame out of multiple profiles 10. Preferably, said frame has a rectangular shape and is formed by the perpendicular association of four base profiles 10 (each one cut at an angle of 45°). The association of base profiles 10 for the formation of the frame is performed by means of a suitable fixing element, like an angle bar, a quick-release device or a screw and nut kit.

It should be highlighted that structural configuration proposed both for the base profile 10 and the finish profile 20 enables the association thereof and subsequently the assembly of the article of manufacture without the need for machining or perforation.

The method further comprises the step of associating a second profile 20 with the first profile 10 by coupling them, wherein said coupling defines a first association position 30 and a second association position 31 of the first profile 10 with the second profile 20. The second profile 20 is, preferably, a finish profile 20.

In said second step, the association through coupling is preferably aided by the assembly protrusions 13, 23. Moreover, the association positions 30, 31 are preferably defined by transversely rotating the profiles 10, 20, as explained before.

In that case, the method for assembling the abovementioned article also comprises an additional step of directly associating the first end 11, 21 of the profile 10, 20 with the structural component 200 of the article of furniture, thus defining the first association position 30, which corresponds to the "FLAT" finish.

Alternatively, such additional step consists in defining a gap 40 between the structural component and the profile 10, 20, said gap 40 being defined by means of a second end 22, thus defining the second association position 31, which corresponds to the "GAP" finish. The first and second association positions 30, 31 are preferably configured by rotating the profile 10, 20.

The method preferably comprises the step of associating the base profile 10 with the structural component 200 of the article of furniture, like a glass or a cover. The association is performed by means of a suitable fixing element, such as a structural adhesive 500, as displayed by FIGS. 5 and 6.

In cases of articles of furniture of considerable dimensions, like in the cases of wardrobes and the like, reinforcement profiles can be utilized for making up the frame formed by the base profiles 10. In such case, the reinforcement profiles are arranged in the center of the frame in order to aid in the structural composition thereof; said reinforcement profile may be arranged in the vertical or horizontal position in relation to the furniture.

Whereas a preferred example of embodiment was herein described, it must be understood that the scope of the present invention encompasses other possible variations, being limited only by the content of the appended claims, including the possible equivalents.

The invention claimed is:

1. A profile for an associated article of furniture, said profile adapted to be engaged with a second associated profile, wherein the profile is structurally configured to be selectively engaged with the second associated profile in first and second orientations to respectively establish at least one of a first association position (30) and a second association position (31,31A) in relation to an associated structural component (200) of the associated article of furniture, wherein the first and second association positions (30,31, 31A) are configured by transverse rotation of the profile in relation to the second associated profile, wherein the profile (20,20A) comprises a first end (21,21A) and a second end (22,22A) defined along opposite sides of its length, wherein the first and second association positions respectively define a first type of finish and a second type of finish of the associated article of furniture, wherein the first type of finish is established due to a first structural configuration of the first end (21,21A) of the profile (20,20A), and the second type of finish is established due to a second structural configuration of the second end (22,22A) of the profile (20,20A), wherein by changing from the first association position (30) to the second association position (31,31A) an overall look of the associated article of furniture is also changed, wherein the overall look of the associated article of furniture is defined due the arrangement of at least one of the first and second ends (21,21A,22,22A) of the profile (20, 20A) in relation to the associated structural component (200) of the associated article of furniture.

2. The profile according to claim 1, wherein the profile comprises at least one first assembly protrusion configured for coupling with at least one second assembly protrusion of the second associated profile (20,20A).

3. The profile according to claim 1, wherein the first end (21,21A) comprises a hook-like shape.

4. The profile according to claim 3, wherein in the first association position said first end (21,21A) of the profile is directly associated with the associated structural component (200) of the associated article of furniture.

5. The profile according to claim 1, wherein the second end (22, 22A) is in the form of a straight structure.

6. The profile according to claim 5, wherein in the second association position a gap (40) is defined between the associated structural component (200) of the associated article of furniture and the second end 22 of the profile (20, 20A).

7. A system (100) of profiles for an associated article of furniture, said system comprising at least a first profile (10,10A) and a second profile (20,20A) that can be associated with the first profile (10,10A), wherein the second profile (20,20A) comprises a first end (21, 21A) and a second end (22, 22A) defined along opposite sides of its length, wherein the second profile (20,20A) is structurally configured to establish at least one of a first association position (30) and a second association position (31,31A) in relation to an associated structural component (200) of the associated article of furniture, wherein the first and second association positions (30,31,31A) are configured by means of relative transverse rotation between at least one of the first and second profiles (10,10A,20,20A) relative to the other of the first and second profiles (10,10A,20,20A), wherein the first and second association positions (30,31,31A) respectively define a first type of finish and a second type of finish of the associated article of furniture, wherein the first type of finish is established due to a first structural configuration of the first end (21,21A) of the second profile (20), and the second type of finish is established due to a second structural configuration of the second end (22,22A) of the second profile (20), wherein by changing from the first association position (30) to the second association position (31,31A) an overall look of the article of furniture is also changed, wherein the overall look of the article of furniture is defined due the arrangement of at least one of the first and second ends (21,21A,22,22A) of the second profile (20,20A) in relation to the associated structural component (200) of the associated article of furniture.

8. The system (100) according to claim 7, wherein the first profile (10,10A) comprises at least one first assembly protrusion (13) configured for coupling with at least one second assembly protrusion (23) of the second profile (20,20A).

9. The system (100) according to claim 8, wherein the first profile (10,10A) comprises an extension (14) adapted to receive the associated structural component (200) of the associated article of furniture, wherein the associated structural component (200) is configured as at least one of the following: a door, a cover, a drawer and a glass.

10. The system (100) according to claim 9, wherein the second end (22,22A) of the second profile (20,20A) is in the form of a straight structure and wherein in the second association position (31) the second end (22,22A) of the second profile (20,20A) defines a gap (40) between the associated structural component (200) and the second profile (20).

11. The system (100) according to claim 10, wherein the first end (21,21A) of the second profile (20,20A) comprises a hook-like shape, which covers the first end (11,11A) of the first profile (10,10A) when the first and second profiles are associated (10,10A, 20,20A) with each other in an arrangement establishing the first association position (30), the first end (21,21A) of the second profile (20,20A) being directly associated with the associated structural component (200).

12. A method for assembling an article of furniture by means of at least a first profile (10) and at least a second profile (20,20A), wherein the second profile (20,20A) comprises a first end (21,21A) and a second end (22,22A) defined along opposite sides of its length, said method comprising:

associating the first profile (10,10A) with a structural component (200) of the article of furniture;

associating the second profile (20,20A) with the first profile (10,10A), wherein said association of the second profile with the first profile defines either a first association position (30) or a second association position (31,31A) between the second profile (20,20A) and the structural component (200) of the article of furniture, wherein the first and second association positions (30, 31,31A) are configured by means of relative transverse rotation of at least one of the first and second profiles relative to the other one of the first and second profiles, wherein the first and second association positions (30, 31,31A) respectively define a first type of finish and a second type of finish of the article of furniture, wherein the first type of finish is established due to a first structural configuration of the first end (21,21A) of the second profile (20,20A), and the second type of finish is established due to a second structural configuration of the second end (22,22A) of the second profile (20,20A), wherein by changing from the first association position (30) to the second association position (31,31A) an overall look of the article of furniture is also changed, wherein the overall look of the article of furniture is defined due the arrangement of at least one of the first and second ends (21,21A,22,22A) of the second profile (20,20A) in relation to the structural component (200) of the article of furniture.

13. The method according to claim 12, wherein the first profile (10,10A) comprises an extension (14) that can receive the structural component (200) of the article of furniture, in such a way that said method comprises the step of:

arranging the second profile relative to the first profile to define the first association position in which the first end (21,21A) of the second profile (20,20A) is directly associated with the structural component (200) of the article of furniture such that the first end (21,21A) of the second profile is located adjacent the structural component (200), or arranging the second profile relative to the first profile to define the second association position in which a gap (40) is defined between the structural component (200) and the second end (22) of the second profile (20).

14. The method according to claim 13, wherein the first and the second profiles (10,10A, 20,20A) are each provided with at least one assembly protrusion (13, 23), said method further comprising the step of:

coupling the at least one assembly protrusion (13) of the first profile (10,10A) with the at least one assembly protrusion (23) of the second profile (20,20A) when the first profile (10,10A) is associated with the second one profile (20,20A).

15. A system (100) of profiles for an associated article of furniture comprising at least a first profile (10,10A) that can be associated with a second profile (20,20A), wherein the second profile (20,20A) is structurally configured to establish at least one of a first association position (30) and a second association position (31) in relation to a structural component (200) of the associated article of furniture, wherein the first and second association positions (30,31) are configured by relative transverse rotation between at least one of the first and second profiles (10,10A,20,20A) relative to the other of the first and second profiles, wherein in the first association position (30) a first end (21,21A) of the second profile (20,20A) is directly associated with the structural component (200) of the article of furniture such that said first end (21,21A) of the second profile (20,20A) is located adjacent the structural component (200) of the article of furniture.

16. A system (100) of profiles for an associated article of furniture comprising at least a first profile (10,10A) that can be associated with a second profile (20,20A), wherein the second profile (20,20A) is structurally configured to establish at least one of a first association position (30) and a second association position (31) in relation to a structural component (200) of the associated article of furniture, wherein the first and second association positions (30, 31) are configured by relative transverse rotation between at least one of the first and second profiles (10,10A,20,20A) relative to the other of the first and second profiles, wherein in the second association position (31) a second end (22, 22A) of the second profile (20,20A) defines a visible perceptible gap (40) between the structural component (200) and the second profile (20,20A).

17. A system (100) of profiles for an associated article of furniture, said system comprising at least a first profile (10,10A) that can be associated with a second profile (20, 20A), wherein the second profile (20,20A) is structurally configured to establish at least one of a first association position (30) and a second association position (31A) in relation to a structural component (200) of the associated article of furniture, wherein the first and second association positions (30, 31A) are configured by relative transverse rotation between at least one of the first and second profiles (10,10A,20,20A) relative to the other of the first and second profiles, wherein in the second association position (31A) a step (40A) is formed between the structural component (200) and the first (10,10A) and second (20,20A) profiles, wherein the step (40A) is formed by a high relief of the structural component (200) in contrast with a low relief formed by the first and second profiles (10,10A,20,20A).

* * * * *